US011851947B2

(12) United States Patent
Balay et al.

(10) Patent No.: US 11,851,947 B2
(45) Date of Patent: Dec. 26, 2023

(54) UNIVERSAL ENDLOCK

(71) Applicant: CORNELLCOOKSON, LLC, Mountain Top, PA (US)

(72) Inventors: Joseph L. Balay, Sugarloaf, PA (US); Christopher J. Rebarchak, White Haven, PA (US); Thomas Balay, Drums, PA (US)

(73) Assignee: CORNELLCOOKSON, LLC, Mountain Top, PA (US)

( * ) Notice: Subject to any disclaimer, the term of this patent is extended or adjusted under 35 U.S.C. 154(b) by 106 days.

(21) Appl. No.: 16/839,577

(22) Filed: Apr. 3, 2020

(65) Prior Publication Data

US 2021/0310302 A1 Oct. 7, 2021

(51) Int. Cl.
*E06B 9/58* (2006.01)
*E06B 9/15* (2006.01)

(52) U.S. Cl.
CPC ..... *E06B 9/581* (2013.01); *E06B 9/15* (2013.01); *E06B 2009/1505* (2013.01); *E06B 2009/1583* (2013.01)

(58) Field of Classification Search
CPC .... E06B 9/581; E06B 9/15; E06B 2009/1505; E06B 2009/1583; E06B 2009/1577; E06B 2009/1594; E06B 2009/1588; E06B 2009/1544; E06B 2009/1533
See application file for complete search history.

(56) References Cited

U.S. PATENT DOCUMENTS 3,782,443 A 1/1974 Clauss et al.
5,927,017 A 7/1999 Jacobs et al.
6,068,040 A * 5/2000 Magro ..... E06B 9/581 160/133
6,666,582 B2 12/2003 Benini et al.
6,860,544 B2 3/2005 Malott
2003/0188837 A1* 10/2003 Varley ..... E06B 9/70 160/264
2005/0011041 A1 1/2005 Ness
2006/0264946 A1* 11/2006 Young ..... A61B 17/1728 606/915
2016/0237744 A1* 8/2016 Storen ..... E06B 9/13
2016/0258177 A1* 9/2016 Faries ..... F16M 13/02
(Continued)

FOREIGN PATENT DOCUMENTS

WO WO-2018183339 A1 * 10/2018 ..... E06B 5/164

OTHER PUBLICATIONS

International Search Report and Written Opinion mailed in corresponding PCT/US2021/025224 dated Jul. 21, 2021, 10 pages.
(Continued)

*Primary Examiner* — Abe Massad
*Assistant Examiner* — John W Hanes, Jr.

(57) ABSTRACT

In example implementations, a universal endlock is provided. The universal endlock includes a body, a first side along a first edge of the body, a second side along a second edge of the body opposite the first edge, a first lip on a first end of the first side, and a second lip on a first end of the second side. The body includes an intersecting hole pattern on a center portion of the body. The first side and the second side are each bent towards a back side of the body. The first lip is bent away from a first edge of the body and the second lip is bent away from the second edge of the body.

3 Claims, 4 Drawing Sheets

(56) References Cited

U.S. PATENT DOCUMENTS

| | | | | |
|---|---|---|---|---|
| 2017/0067285 | A1* | 3/2017 | Lambridis | E06B 9/17046 |
| 2019/0323282 | A1 | 10/2019 | Sowinski | |
| 2019/0390511 | A1* | 12/2019 | Lambridis | E06B 9/70 |

OTHER PUBLICATIONS

1st Substantive Examination Report mailed in corresponding SA Patent Application No. 522440789 dated Dec. 28, 2022, 11 pages.

* cited by examiner

UNIVERSAL ENDLOCK

BACKGROUND

Roll-up doors are often used to form closures over openings in buildings, such as garages, warehouses, stores, etc. Such a roll-up door may be opened and closed by coiling or uncoiling the roll-up door around a shaft. The shaft may be controlled by a motor to open and close the roll-up door.

The roll-up door may be formed by slats that are coupled together and placed in a guide. The guide may help the slats to maintain alignment during movement as the roll-up door is opened and closed.

DETAILED DESCRIPTION

Examples described herein provide examples of a universal endlock. As discussed above, a roll-up door may include connected slats that are coiled around a shaft to open and uncoiled to close. The slats may be fabricated from metal and secured together within guides along the side of the opening or door.

The slats may be connected at the ends with an endlock. Previous endlocks were designed for either the left side or the right side of the slats. In addition, different endlocks may be used for different slats depending on a spacing of openings on the slats. Thus, different types of endlocks were used to connect the slats. This may lead to additional overhead, inventory, and costs associated with maintaining and/or building the different types of endlocks.

In addition, the previous endlock designs were made to have a profile that extends beyond the profile of the slats. Thus, portions of the endlocks may protrude above the individual slat external surface. As the roll-up door was coiled around the shaft to open the door, the weight of each coil of slats would press down on the endlocks. The protruding portion of the endlock may press against an adjacent slat rolled below and create a bending moment in the end of the adjacent slat. Over time, the ends of the slats may crack or tear. Eventually, the endlocks may be ripped off and the roll-up door may not function properly.

The universal endlock of the present disclosure may be designed to work on either end of the slats. In addition, the universal endlock of the present disclosure may include intersecting hole patterns to allow the universal endlock to be connected to different types of slats with differently spaced openings. Thus, a single type of endlock may be manufactured and maintained in inventory, which may lead to lower costs.

In addition, the universal endlock of the present disclosure may have a profile that is lower than the profile of the slat. Thus, when the roll-up door is coiled around the shaft when opened, the endlock may not create a bending moment on adjacent slats rolled below the endlock. Thus, cracking caused by known endlocks may be eliminated and the slats may have a longer life span.

Figure 1:
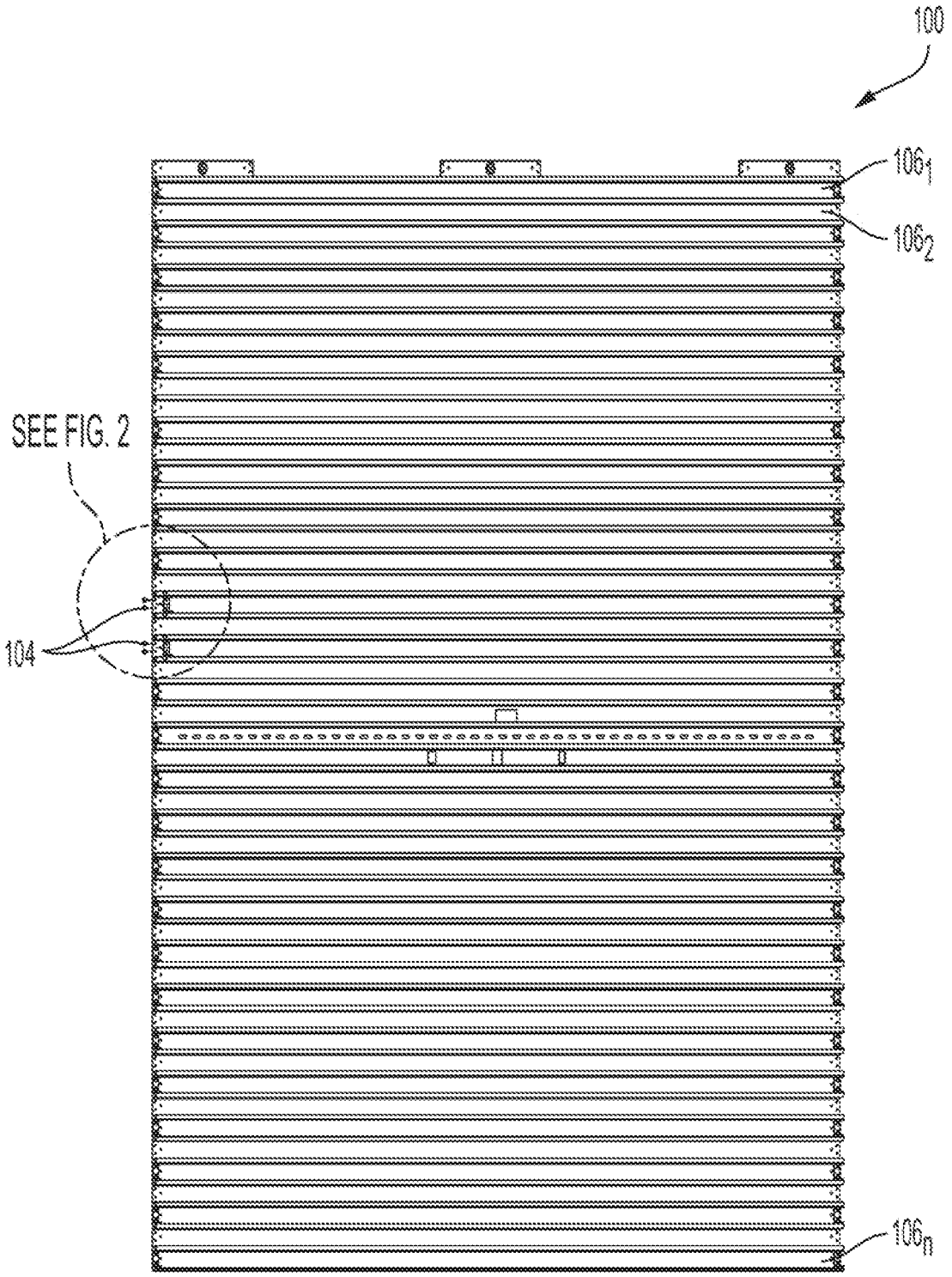
FIG. 1 is a block diagram of an example roll-up door with an example universal endlock of the present disclosure.

FIG. 1 illustrates an example roll-up door 100 having universal endlocks 104 of the present disclosure. The roll-up door 100 may be located over an opening of a building or factory. It should be noted that FIG. 1 has been simplified for ease of explanation. For example, the roll-up door 100 may include additional components that are not shown. For example, the roll-up door 100 may be coupled to a shaft that is coupled to a motor. The motor may rotate the shaft to coil and/or uncoil the roll-up door 100 around the shaft. The roll-up door 100 may also include guides that help keep the roll-up door 100 aligned and provide efficient movement when coiled and/or uncoiled around the shaft. Other components may include a hood to cover the motor, a bottom bar to provide a weather-seal or locking mechanism, a counterbalance shaft, an adjustor bracket, and the like.

In one embodiment, the roll-up door 100 may be comprised of a plurality of slats $\mathbf{106}_1$ to $\mathbf{106}_n$ (hereinafter also referred to individually as a slat 106 or collectively as slats 106). The slats 106 may be fabricated from metal (e.g., aluminum, steel, alloys, and the like). Each slat 106 has an elongated structure with a width and a profile with a first rounded end at the top of the slat 106, a second rounded end at the bottom of the slat 106, a left end of the slat 106 and a right end of the slat 106. The first rounded end and the second rounded end are oriented parallel to each other, and the left end and the right end are oriented parallel to each other and perpendicular to the first rounded end and the second rounded end. The profile of the slat 106 is such that there is a front face of the slat and a back face of the slat 106. The profile further includes the first rounded end in a hook shape or "C" shape and the second rounded end in a hook shape or "C" shape that is able to slidably engage to the first rounded end. A detailed view of the slat 106 with the rounded ends is illustrated in FIG. 2 and discussed below.

It is intended that known profile designs and engagement designs for a single wall slat or a double walled slat (for insulated slats) are contemplated to be used with the endlocks and described herein.

In one embodiment, the slats 106 may be coupled together via a mechanical coupling and held in place by the universal endlocks 104. The universal endlocks 104 may be coupled on each end of alternating slats 106. Said another way, the universal endlocks 104 may be coupled on each end of every other slat 106.

Figure 2:
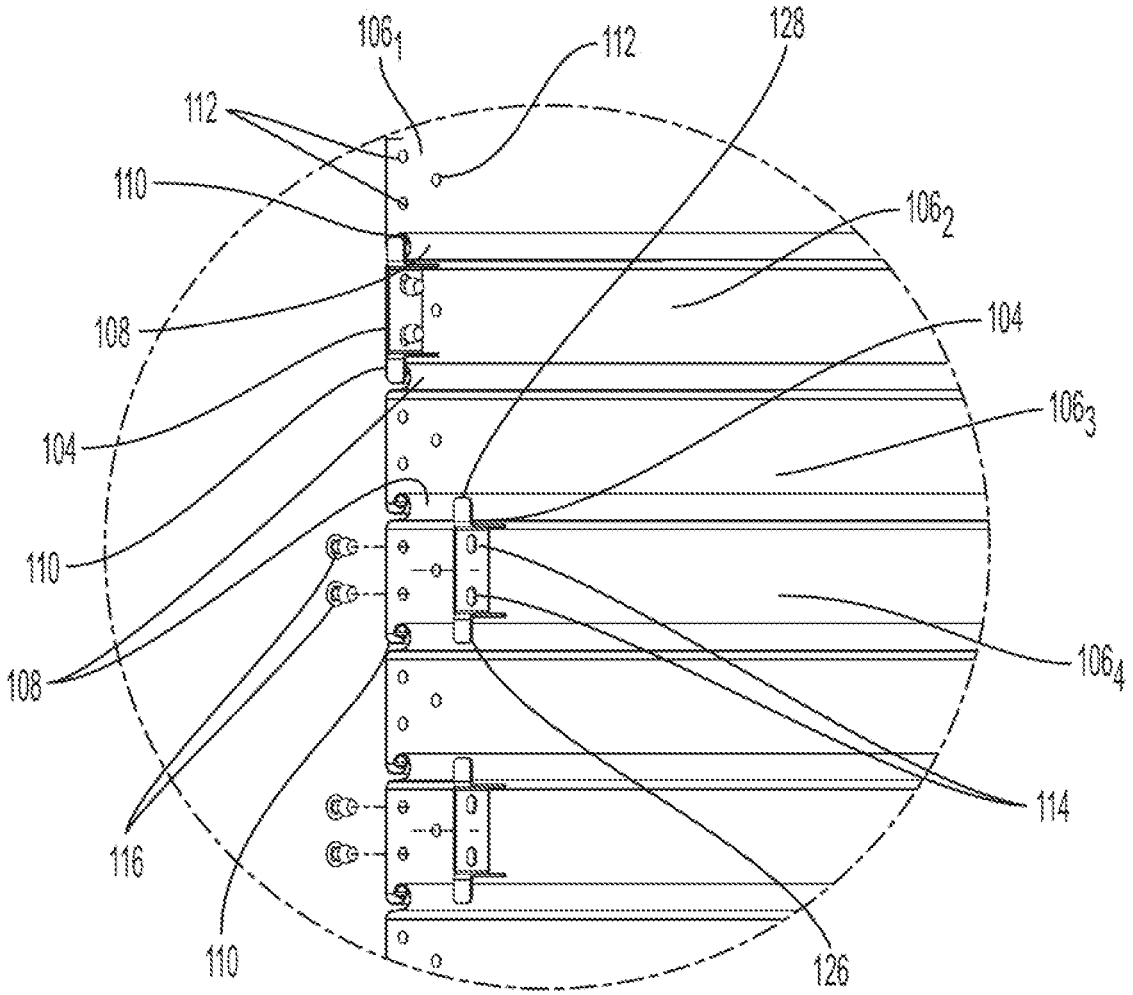
FIG. 2 is a block diagram of a more detailed exploded view of the example universal endlock coupled to slats of the roll-up door of the present disclosure.

FIG. 2 illustrates a more detailed exploded view of how the universal endlocks 104 are coupled to the slats 106. For example, each slat 106 may include a first rounded end 108 and a second rounded end 110. The second rounded end 110 may have a diameter that is smaller than the first rounded end 108. However, it should be noted that the second rounded end 110 may be designed to have a diameter that is larger than the first rounded end 108.

In one embodiment, the first rounded end 108 and the second rounded end 110 may have a spiral form. As a result, the second rounded end 110 of a first slat $\mathbf{106}_1$ may be slid into the first rounded end 108 of an adjacent slat $\mathbf{106}_2$. Similarly, the second rounded end 110 of the slat $\mathbf{106}_2$ may be slid into the first rounded end 108 of an adjacent slat $\mathbf{106}_3$, and so forth. The spiral form and concentric fit of the first rounded end 108 of a first slat $\mathbf{106}_1$ and second rounded end 110 of an adjacent slat $\mathbf{106}_2$ may help keep the slats 106 interlocked.

In one embodiment, the universal endlocks 104 may be coupled to the ends of a slat 106 via a fastener 116. The fastener 116 may be any type of mechanical fastener. For example, the fastener 116 may be a screw, a bolt, a nut and bolt combination, a rivet, and the like.

In one embodiment, the universal endlocks 104 may have intersecting hole patterns 114. The intersecting hole patterns 114 of the universal endlocks 104 may be aligned with openings 112 of the slat 116. The fastener 116 may be fed through the openings 112 and the intersecting hole patterns 114 that are aligned to couple the universal endlock 104 to the end of a slat 106. A double walled slat with a front wall and a back wall may have holes in each wall or in a single wall of the slat for the attachment of the endlocks 104.

In one embodiment, the universal endlock 104 may include a first lip 126 and a second lip 128. The first lip 126 may secure the interlocking of the second rounded end 110 of a first slat $\mathbf{106}_1$ to the first rounded end 108 of the slat $\mathbf{106}_2$. The second lip 128 may secure the second rounded end 110 of the slat $\mathbf{106}_2$ to the first rounded end 108 of the slat $\mathbf{106}_3$. Thus, the first lip 126 and the second lip 128 may be coupled to each end of the slat $\mathbf{106}_2$ to prevent the slat $\mathbf{106}_2$ from moving laterally (e.g., side-to-side or left and right along the page) to become disconnected from the adjacent slats $\mathbf{106}_1$ and $\mathbf{106}_3$.

In one embodiment, the universal endlock 104 may be coupled to each end of every other slat 106 as noted above. For example, if the first universal endlock 104 is coupled to the slat $\mathbf{106}_2$, then the second universal endlock 104 may be coupled to each end of the slat $\mathbf{106}_4$, the third universal endlock 104 may be coupled to each end of the slat $\mathbf{106}_6$, and so forth.

In one embodiment, the design of the universal endlock 104 may allow the same universal endlock 104 to be coupled to either end (e.g., left end or right end) of the slat 106. In other words, two different endlocks are not needed to secure the lefts side of the slat 106 and the right side of the slat 106.

In addition, the intersecting hole pattern 114 of the universal endlock 104 may allow the universal endlock 104 to be coupled to different types of slats. For example, the spacing of the openings 112 may be different on different types of slats 106. Thus, a single universal endlock 104 may be coupled to different types of slats 106 with different spacings of openings 112.

In one embodiment, the universal endlock 104 may be fabricated from stamped steel or metal. In another embodiment, the universal endlock 104 may be fabricated or molded from nylon (or any other suitable plastic or polymer). FIGS. 3-6 illustrate various views and dimensions for the universal endlock 104 when fabricated from stamped metal. FIGS. 7-10 illustrate various views and dimensions for the universal endlock 104 when fabricated from nylon. Where certain features are shared in both materials the same reference numerals are used. However, certain features may differ between the stamped metal endlock and the nylon endlock. In such cases, different reference numerals may be used.

Figure 3:
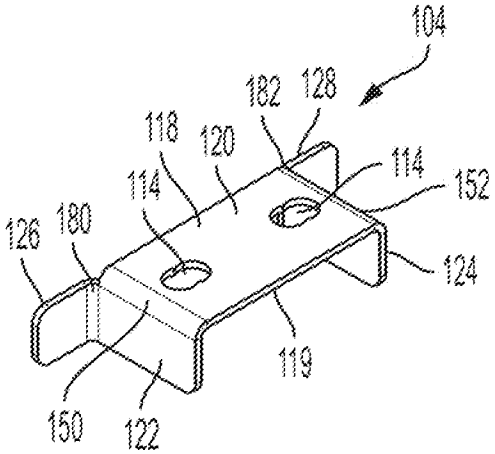
FIG. 3 is a block diagram of an isometric view of the example universal endlock of the present disclosure.

FIG. 3 illustrates an isometric view of an example of the universal endlock 104 that is fabricated from stamped metal or steel. In one embodiment, the universal endlock 104 may include a body 120. The body 120 may have a top or front side 118 and a bottom or back side 119. The body 120 may also have a first edge 150 and a second edge 152.

In one embodiment, a first side 122 may be formed along the first edge 150 and a second side 124 may be formed along the second edge 152. The first edge 150 and the second edge 152 may be angled or curved. The first side 122 and the second side 124 may be bent towards the back side 119. The first side 122 and the second side 124 may be bent to approximately 90 degrees relative to the body 120. In other words, a plane of the front side 120 may be positioned approximately at 90 degrees or perpendicular relative to a plane on the first side 122 and the second side 124. It should be noted that the term "plane" may refer to an infinite two dimensional imaginary surface that would lie parallel to a particular surface.

In one embodiment, a first lip 126 may be formed along a first end 180 of the first side 122. A second lip 128 may be formed along a first end 182 of the second side 124. In one embodiment, the first lip 126 may be bent away from the first edge 150 and the second lip 128 may bent away from the second edge 152. The first lip 126 may be bent such that a plane of the first lip 126 is approximately 90 degrees or perpendicular to a plane of the first side 122. The second lip 128 may be bent such that a plane of the second lip 128 is approximately 90 degrees or perpendicular to a plane of the second side 124.

In one embodiment, a surface of the first lip 126 and a surface of the second lip 128 may lie on a common plane. The common plane of the first lip 126 and the second lip 128 may be approximately 90 degrees or perpendicular to a plane of the front side 118 of the body 120.

In one embodiment, the body 120, the first side 122, the second side 124, the first lip 126, and the second lip 128 may be formed from a single continuous piece of metal or steel. The metal or steel may be stamped to form the features and shapes in the relative orientation as described above. In another embodiment, the body 120, the first side 122, the second side 124, the first lip 126, and the second lip 128 may be coupled together as separate pieces via welding, glue, or any other coupling mechanism.

In one embodiment, the universal endlock 104 may include intersecting hole patterns 114. In one embodiment, each intersecting hole pattern 114 may be formed by an intersection of two circles at two points. The intersecting hole patterns 114 may be located in an approximate center of a width the body 120. The intersecting hole patterns 114 may be located towards the first end 150 and the second end 152 along a length of the body 120. As a result, the intersecting hole pattern 114 may allow a fastener to be positioned in two different positions, allowing the universal endlock 104 to be coupled to different types of slats 106 with differently spaced openings 112.

Figure 4:
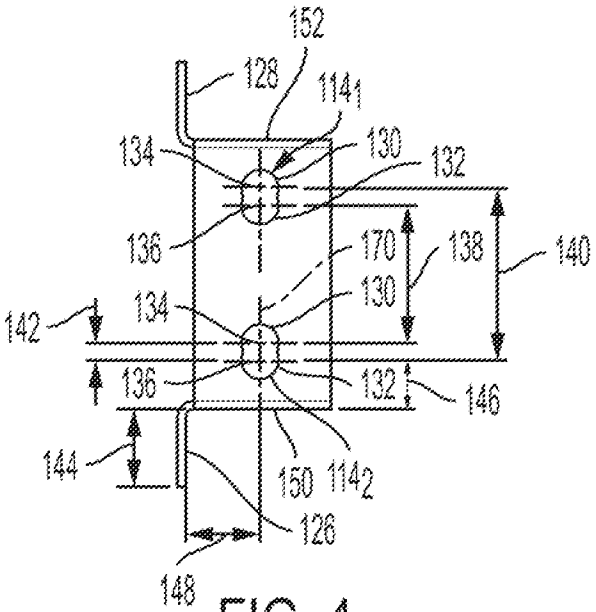
FIG. 4 is a block diagram of a top view of the example universal endlock of the present disclosure.

FIG. 4 illustrates a top view of the universal endlock 104. In one embodiment, the intersecting hole pattern 114 may be formed by two intersecting circles 130 and 132, as noted above. A center 134 of a first circle 130 may be spaced apart a distance 142 from a center 136 of the second circle 132. In one embodiment, the distance 142 may be approximately 0.125 inches+/−0.05 inches.

In one embodiment, a radius of the first circle 130 and the second circle 132 may be a function of the opening 112 of the slat 106 and a size of the fasteners used to couple the universal endlock 104 to the slat 106. In one embodiment, the radius of the first circle 130 and the second circle 132 may be approximately 0.136 inches+/−0.05 inches.

In one embodiment, the universal endlock 104 may include a pair of intersecting hole patterns $\mathbf{114}_1$ and $\mathbf{114}_2$. In one embodiment, the centers 134 and 136 of the intersecting hole patterns $\mathbf{114}_1$ and $\mathbf{114}_2$ may be aligned such that they lie on a common line that runs along a length of the body 120. In one embodiment, the common line may be located at approximately a center or midpoint of a width of the body 120. Line 170 illustrates an example line that may represent the common line that aligns the centers 134 and 136 of the intersecting hole patterns $\mathbf{114}_1$ and $\mathbf{114}_2$.

In one embodiment, a distance 138 between the center 136 of the intersecting hole pattern $\mathbf{114}_1$ and the center 134 of the intersecting hole pattern $\mathbf{114}_2$ may be approximately 1.00 inch+/−0.005 inches. In one embodiment, a distance 140 between the center 134 of the intersecting hole pattern $\mathbf{114}_1$ and the center 136 of the intersecting hole pattern $\mathbf{114}_2$ may be approximately 1.250 inches+/−0.005 inches.

In one embodiment, the intersecting hole patterns $\mathbf{114}_1$ and $\mathbf{114}_2$ may be located a distance 146 from the first edge 150 and the second edge 152, respectively. In one embodiment, the distance 146 may be 0.356 inches+/−0.005 inches.

Although the intersecting hole patterns $\mathbf{114}_1$ and $\mathbf{114}_2$ may have two intersecting circles 130 and 132, it should be noted that the intersecting hole patterns $\mathbf{114}_1$ and $\mathbf{114}_2$ may be formed from any number of intersecting circles. For example, if the slats 106 have openings 112 that are spaced in three different ways, then the intersecting hole pattern 114 may be formed by three intersecting circles. The opening between the intersecting circles may be small enough that the fastener would not be able to slide left and right when secured to the universal endlock 104 and the slat 106.

As can be seen in FIG. 4, the first lip 126 and first edge 150 and the second lip 128 and the second edge 152 may each form an "L" shape. In one embodiment, the first lip 126 and the second lip 128 may be formed a distance 148 relative to the center 134 or 136 of the intersecting hole patterns $\mathbf{114}_1$ and $\mathbf{114}_2$. The distance 148 may allow a sufficient amount of the body 120 to be inserted into the slat 106 to provide leverage for the first lip 126 and the second lip 128 to secure adjacent slats 106, as described above and illustrated in FIG. 2. In one embodiment, the distance 148 may be approximately 0.542 inches+/−0.05 inches.

In one embodiment, the first lip 126 and the second lip 128 may extend away from the first edge 150 and the second edge 152, respectively, with a length 144 that is sufficient to cover the circumference of the first rounded end 108 of a slat 106. Thus, when the first rounded end 108 and the second rounded end 110 of adjacent slats are interlocked, the first lip 126 and the second lip 128 may prevent the second rounded end 110 from sliding out of the first rounded end 108, as described above. In one embodiment, the length 144 may be approximately 0.565 inches+/−0.05 inches.

Figure 5:
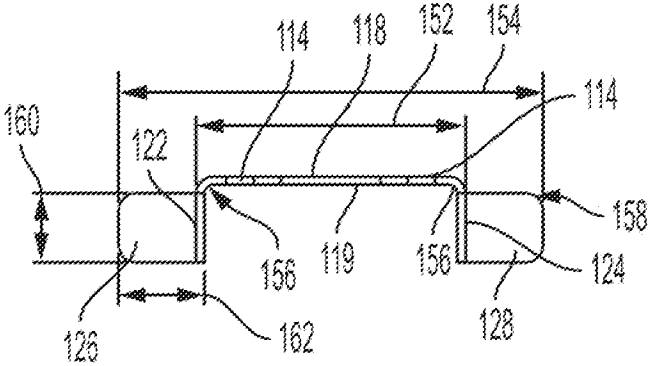
FIG. 5 is a block diagram of a front view of the example universal endlock of the present disclosure.

FIG. 5 illustrates a front view of the universal endlock 104. In one embodiment, the first side 122, the body 120, and the second side 124 may form a sideways "C" shape. As can be seen in FIG. 5, the first side 122 and the second side 124 may be bent towards the backside 119 of the body 120 or away from the front side 118 of the body 120. The first side 122 and the second side 124 may be bent at approximately 90 degrees or perpendicular to the body 120.

In one embodiment, the first side 122 and the second side 124 may be bent from the body 120 with a curve 156. In one embodiment, the curve 156 may have a radius of curvature of approximately 0.060 inches+/−0.005 inches. In another embodiment, the first side 122 and the second side 124 may be bent at an approximately 90 degree angle.

In one embodiment, a length 152 of the body 120 may be approximately 1.900 to 2.000 inches+/−0.005 inches. In one embodiment, the length 152 may be approximately 1.963 inches. In one embodiment, an overall length 154 of the universal endlock 104 may be approximately 3.000 inches to 3.100 inches+/−0.005 inches. In one embodiment, the overall length 154 may be approximately 3.093 inches.

In one embodiment, a height 160 or profile 160 of the first lip 126 and the second lip 128 may be less than a diameter or profile of the first rounded end 108 of the slats 106. As a result, when the universal endlock 104 is coupled to the slat 106, the first lip 126 and the second lip 128 may not protrude beyond the outer edges of the first rounded end 108. Thus, when the roll-up door 100 is coiled to open, the first lip 126 and/or the second lip 128 may not apply a bending force to slats located below that are coiled underneath.

In one embodiment, the height 160 of the first lip 126 and the second lip 128 may be the same and may be a function of the diameter of the first rounded end 108. In one embodiment, the height 160 may be approximately 0.450 inches to 0.550 inches+/−0.005 inches. In one embodiment, the height 160 may be approximately 0.505 inches.

In one embodiment, the thickness of the first side 122 and a length of the first lip 126 may have a total length 162. In one embodiment, the total length 162 may be approximately 0.625 inches+/−0.005 inches. The thickness of the second side 124 and the second lip 128 may have a similar total length 162.

In one embodiment, the corners 158 of the first lip 126 and the second lip 128 may be rounded. In one embodiment, the corners 158 may be rounded to have a radius of curvature of approximately 0.125 inches+/−0.005 inches.

Figure 6:
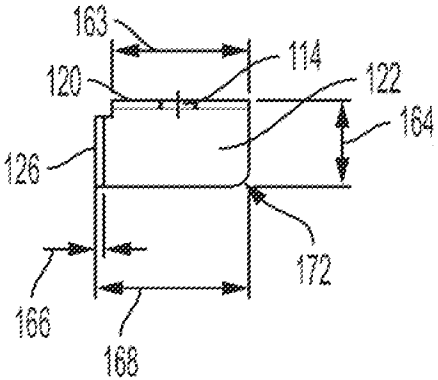
FIG. 6 is a block diagram of a side view of the example universal endlock of the present disclosure.

FIG. 6 illustrates a side view of the universal endlock 104. In one embodiment, the first lip 126 and the second lip 128 may have a thickness 166 that is sufficient to resist bending under the lateral force of the slats 106. In one embodiment, the thickness 106 may be approximately 0.060 inches+/−0.005 inches.

In one embodiment, the body 120 may have a width 163. The width 163 may be approximately 1.000 inches+/−0.005 inches. In one embodiment, the universal endlock 104 may have an overall width 168. The overall width 168 may be approximately 1.120 inches+/−0.005 inches.

In one embodiment, the universal endlock 104 may have a height 164. In one embodiment, the height 164 may be approximately 0.625 inches+/−0.005 inches.

FIG. 6 also illustrates how some corners of the first side 122 and the second side 124 may be curved. For example, the corner 172 of the first side 122 and the second side 124 may be curved or rounded rather than being 90 degree corner.

As noted above, FIGS. 7-10 illustrate various views of an example universal endlock 104 fabricated from nylon or any other type of plastic or polymer. The universal endlock 104 fabricated from nylon may be similar in many respects to the universal endlock 104. Thus, many of the same reference numerals are used for the universal endlock 104 illustrated in FIGS. 7-10 as used in the universal endlock 104 illustrated in FIGS. 3-6. However, the universal endlock 104 may have some different features and different dimensions, which are described below and illustrated in FIGS. 7-10.

Figure 7:
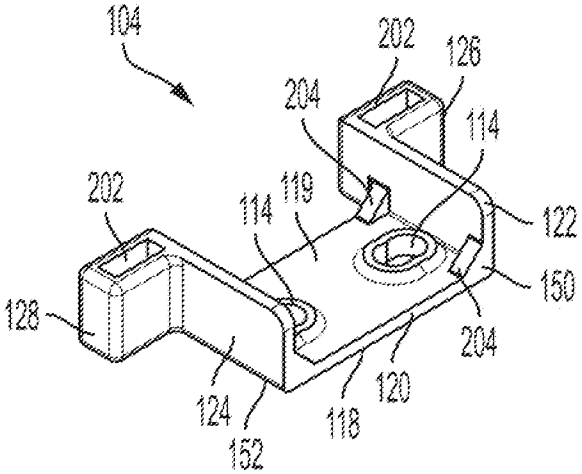
FIG. 7 is a block diagram of an isometric view of a second example universal endlock of the present disclosure.

FIG. 7 illustrates a bottom isometric view of an example universal endlock 104 fabricated from nylon. In one embodiment, the universal endlock 104 may include intersecting hole patterns 114 formed along an approximate center of a width of the body 120.

In one embodiment, the universal endlock 104 may include a first side 122, a second side 124, a first lip 126, and a second lip 128. The first side 122 may be bent along a first edge 150, as described above. The first lip 126 may be bent away from the first edge 150 and oriented relative to the body 120 and the first side 122, as described above.

In one embodiment, the second side 124 may be bent along a second edge 152, as described above. The second lip 128 may be bent away from the second edge 152 and oriented relative to the body 120 and the second side 124, as described above.

In one embodiment, the body 120, the first side 122, the second side 124, the first lip 126, and the second lip 128 may be molded from nylon as a single continuous piece. In another embodiment, the body 120, the first side 122, the second side 124, the first lip 126, and the second lip 128 may be coupled together as separate pieces using glue, melting/fusing techniques, and the like.

As shown in FIG. 7, the universal endlock 104 fabricated from nylon may include a rectangular volume 202 in the first lip 126 and the second lip 128. The rectangular volume 202 may be created by a rectangular shaped block with a hollow center that provides additional strength for the first lip 126 and the second lip 128.

In one embodiment, the universal endlock 104 fabricated from nylon may also include gussets 204 that are formed between a bottom side 119 of the body 120 and the first side 122 and the second side 124. In one embodiment, two gussets 204 may be formed between the body 120 and the first side 122 and two gussets 204 may be formed between the body 120 and the second side 124. The gussets 204 may provide additional strength to prevent the first side 122 and the second side 124 from being bent towards each other and breaking off from the body 120.

Figure 8:
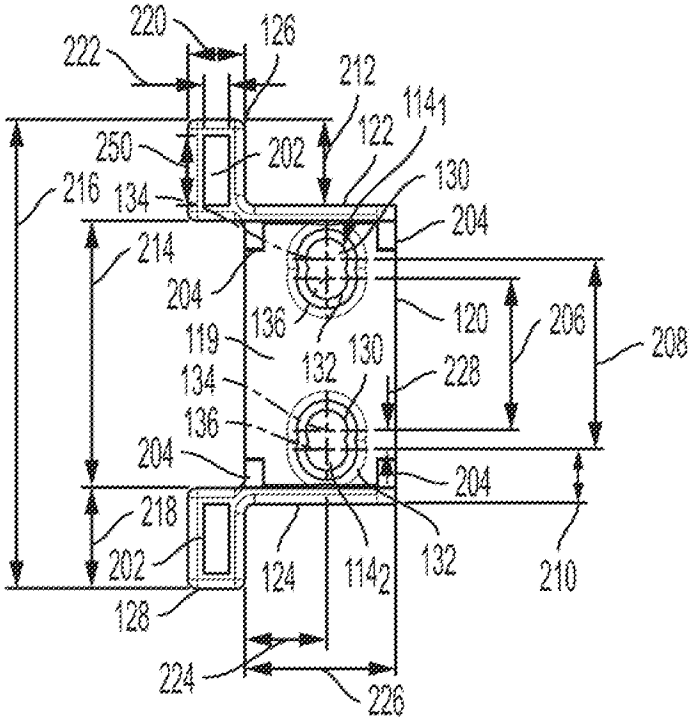
FIG. 8 is a block diagram of a bottom view of the second example universal endlock of the present disclosure.

FIG. 8 illustrates a bottom view of the universal endlock 104. In one embodiment, the center 134 of the circle 130 and the center 136 of the circle 132 may be separated by a distance 228. In one embodiment, the distance 228 may be approximately 0.125 inches+/−0.005 inches. In one embodiment, the center 136 of the intersecting hole pattern $\mathbf{114}_1$ may be separated by a distance 206 from the center 134 of the intersecting hole pattern $\mathbf{114}_2$. The distance 206 may be approximately 1.000 inches+/−0.005 inches. In one embodiment, the center 134 of the intersecting hole pattern $\mathbf{114}_1$ may be separated by a distance 208 from the center 136 of the intersecting hole pattern $\mathbf{114}_2$. The distance 208 may be approximately 1.250 inches+/−0.005 inches.

In one embodiment, the volume 202 may have a width 222 and a length 250. In one embodiment, the width 222 may be approximately 0.165 inches+/−0.005 inches. In one embodiment, the length 250 may be approximately 0.460 inches+/−0.0005 inches.

In one embodiment, the first lip 126 and the second lip 128 may have a width 220 and a length 218. In one embodiment, the width 220 may be approximately 0.375 inches+/−0.015 inches. The length 218 may be approximately 0.670 inches+/−0.015 inches.

In one embodiment, the outer edge of the first lip 126 from the first side 122 or the outer edge of the second lip 128 from the second side 124 may be set at a distance 212. In one embodiment, the distance 212 may be approximately 0.565 inches+/−0.005 inches.

In one embodiment, an inner side of the first lip 126 and the second lip 128 may be set at a distance 224 from a center 134 or 136 of the intersecting hole pattern 114. In one embodiment, the distance 224 may be approximately 0.542 inches+/−0.010 inches.

In one embodiment, the body 120 may have a length 214. The length 214 may be approximately 1.754 inches+/−0.005 inches. In one embodiment, the body 120 may have a width 226. The width 226 may be approximately 1.000 inches+/−0.005 inches.

In one embodiment, the universal endlock 104 may have an overall length 216. The overall length 216 may be approximately 2.900 inches to 3.100 inches. In one embodiment, the overall length 216 may be approximately 3.093 inches+/−0.005 inches.

Figure 9:
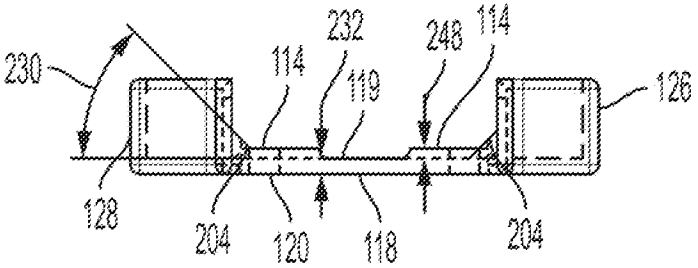
FIG. 9 is a block diagram of a front view of the second example universal endlock of the present disclosure.

FIG. 9 illustrates a front view of the universal endlock 104 fabricated from nylon. In one embodiment, the gussets 204 may be formed to have a surface that is angled at an angle 230 relative to the first side 122 or second side 124 and the body 120. In one embodiment, the angle 230 may be approximately 45 degrees+/−5 degrees.

In one embodiment, the body 120 may have a thickness 232. The thickness 232 of the body 120 may be approximately 0.105 inches+/−0.005 inches.

In one embodiment, the interlocking hole patterns 114 of the universal endlock 104 fabricated from nylon may include a lip. The lip may help provide structural integrity and additional strength to support a fastener coupled against the interlocking hole pattern 114 and the slat 106. In one example, the lip may have a height 248. The height 248 of the lip may be approximately 0.063 inches+/−0.005 inches.

Figure 10:
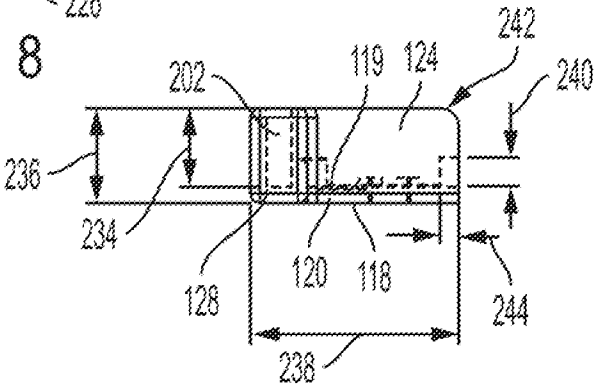
FIG. 10 is a block diagram of a side view of the second example universal endlock of the present disclosure.

FIG. 10 illustrates a side view of the universal endlock 104 fabricated from nylon. In one embodiment, the universal endlock 104 may have a height 236 that is the same as the height 236 of the first lip 126 and the second lip 128. As noted above, the height or profile 236 of the first lip 126 and the second lip 128 may be less than the diameter or profile of the first rounded end 108 of the slat 106. As a result, when the universal endlock 104 fabricated from nylon is coupled to the slat 106, the first lip 126 and the second lip 128 may not protrude beyond the outer edges of the first rounded end 108. Thus, when the roll-up door 100 is coiled to open, the first lip 126 and/or the second lip 128 may not apply a bending force to slats located below that are coiled underneath.

In one embodiment, the height 236 may be a function of the diameter of the first rounded end 108. In one embodiment, the height 236 may be approximately 0.625 inches+/−0.015 inches.

In one embodiment, a height 234 of the volume 202 may be measured from a bottom of the volume 202 to a top of the first lip 126 or the second lip 128. In one embodiment, the height 234 of the volume 202 may be approximately 0.520 inches+/−0.005 inches. In other words, the depth of the volume 202 may be approximately 0.520 inches+/−0.005 inches.

In one embodiment, the universal endlock 104 fabricated from nylon may have an overall width 238. In one embodiment, the overall width 238 may be a sum of the width 226 of the body 120 and the width 220 of the first lip 126 or the second lip 128. The overall width 238 may be approximately 1.375 inches+/−0.005 inches.

In one embodiment, the gusset 204 may be formed with a width 244 and a height 240. In one embodiment, the width 244 may be approximately 0.125 inches+/−0.005 inches. In one embodiment, the height 240 may be approximately 0.189 inches+/−0.005 inches.

The present disclosure provides various dimensions for the universal endlock 104 fabricated from stamped steel/metal or nylon. It should be noted that the dimensions are provided as examples. However, as the size and dimensions of the slats 106 are changed, the dimensions of the universal endlock 104 may also be changed. However, the proportions of the dimensions relative to the various components (e.g., the dimensions of the first lip 126 to the first side 122 and the body 120) may remain constant even when the size of each individual dimension is changed.

Thus, the present disclosure provides a universal endlock 104 that may prevent slats 106 from being damaged as the roll-up door is coiled up and down. In addition, the universal endlock 104 may be used on either side of the roll-up door 100 to secure adjacent slats 106. Lastly, the universal endlock 104 of the present disclosure may be used on different types of slats 106 with different spacings of the openings 112.

As a result, a single universal endlock 104 may be manufactured and kept in inventory to reduce overall installation costs, manufacturing costs and inventory costs. In addition, the life of the roll-up door 100 may be increased as the universal endlock 104 of the present disclosure may prevent damage to the slats 106 unlike previous endlock designs.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the following claims.

The invention claimed is:

1. A roll-up door, comprising:

a first slat, comprising:

a first rounded end;

a second rounded end, wherein the second rounded end has a smaller circumference than the first rounded end; and a pair of openings;

a second slat having a second rounded end inserted into the first rounded end of the first slat;

a third slat having a first rounded end, wherein the second rounded end of the first slat is inserted into the first rounded end of the third slat; and an endlock coupled to the first slat, wherein the endlock comprises:

a body;

a first side coupled to a first edge of the body, wherein the first side is bent approximately 90 degrees towards a back side of the body via a curve of the first edge;

a second side coupled to a second edge of the body, wherein the second side is bent approximately 90 degrees towards the back side of the body via a curve of the second edge, wherein the first side is opposite the second side;

a first lip having a first surface coupled to a first end of the first side to secure the second rounded end of the second slat into the first rounded end of the first slat, wherein the first lip is bent away from the first edge of the body to be perpendicular to the first side;

a second lip having a second surface coupled to a second end of the second side to secure the second rounded end of the first slat into the first rounded end of the third slat, wherein the second lip is bent away from the second edge of the body to be perpendicular to the second side, wherein the first surface and the second surface each have a length sufficient to cover a circumference of the first rounded end of the first slat or the first rounded end of the third slat, wherein the first surface of the first lip and the second surface of the second lip lie on a common plane, wherein the common plane of the first lip and the second lip is perpendicular to a surface of the body; and a pair of intersecting hole patterns located in a center of a width of the body, wherein a first intersecting hole pattern of the pair is located towards the first edge along a length of the body and a second intersecting hole pattern of the pair is located towards the second edge along the length of the body, wherein each one of the pair of intersecting hole patterns is formed by an intersection of two circles at two points such that centers of the two circles are approximately 0.125 inches apart, wherein the endlock is coupled to the first slat via fasteners fed through the pair of intersecting hole patterns and the pair of openings of the first slat.

2. The roll-up door of claim 1, wherein a width of the first lip is less than a width of the first rounded end of the first slat.

3. The roll-up door of claim 1, wherein a width of the second lip is less than a width of the first rounded end of the third slat.

* * * * *